United States Patent [19]

Tank et al.

[11] 4,036,293

[45] July 19, 1977

[54] HEAT EXCHANGER FOR GASES OF GREATLY VARYING TEMPERATURES

[75] Inventors: Eggert Tank, Fellbach; Manfred Stute, Esslingen, both of Germany

[73] Assignee: Daimler-Benz Aktiengesellschaft, Germany

[21] Appl. No.: 477,187

[22] Filed: June 7, 1974

[30] Foreign Application Priority Data

June 9, 1973 Germany ..... 2329634
June 9, 1973 Germany ..... 2329636

[51] Int. Cl.[2] ..... F28F 19/00

[52] U.S. Cl. ..... 165/134; 165/81; 165/142; 165/145; 165/158

[58] Field of Search ..... 165/145, 134, 142, 176, 165/178; 122/511

[56] References Cited

U.S. PATENT DOCUMENTS

| | | | |
|---|---|---|---|
| 1,879,027 | 9/1932 | Bassler | 165/134 |
| 2,392,638 | 1/1946 | Bowman et al. | 165/134 |
| 2,564,153 | 8/1951 | Comeau | 165/81 |
| 3,078,919 | 2/1963 | Brown | 165/142 |
| 3,132,691 | 5/1964 | Esleeck | 165/158 |
| 3,433,298 | 3/1969 | Vollhardt | 165/160 |
| 3,746,083 | 7/1973 | Tiefenbacher | 165/145 |

FOREIGN PATENT DOCUMENTS

| | | | |
|---|---|---|---|
| 590,876 | 12/1933 | Germany | 165/134 |

*Primary Examiner*—Carroll B. Dority, Jr.
*Assistant Examiner*—Daniel J. O'Connor
*Attorney, Agent, or Firm*—Craig & Antonelli

[57] ABSTRACT

A heat-exchanger for gases of greatly varying temperatures, especially for use in gas turbines, which essentially consists of a collective space, for example, of a pipe-shaped collective space for the cold gas and of a metal recuperator which is formed by a large number of preferably U-shaped pipes which are welded or brazed into the collective chamber, whereby the hotter gases flow through between the pipes of the recuperator to give off some of their heat to the compressor air flowing through these pipes; one or several protective sheet metal members are arranged within the area of the connecting places between the pipes of the recuperator and the collective chamber which protect the welded or brazed joints against the hot gases.

54 Claims, 9 Drawing Figures

FIG. 1
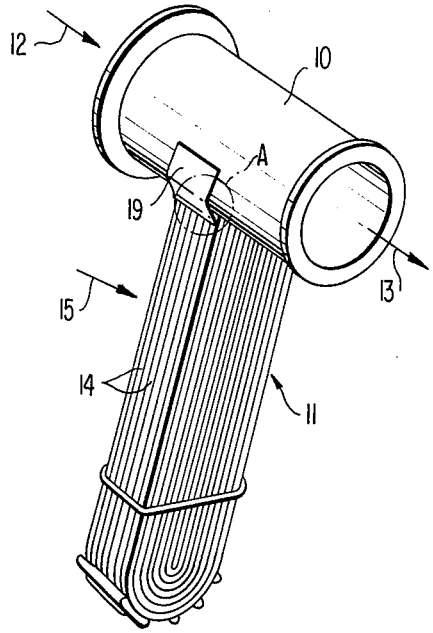
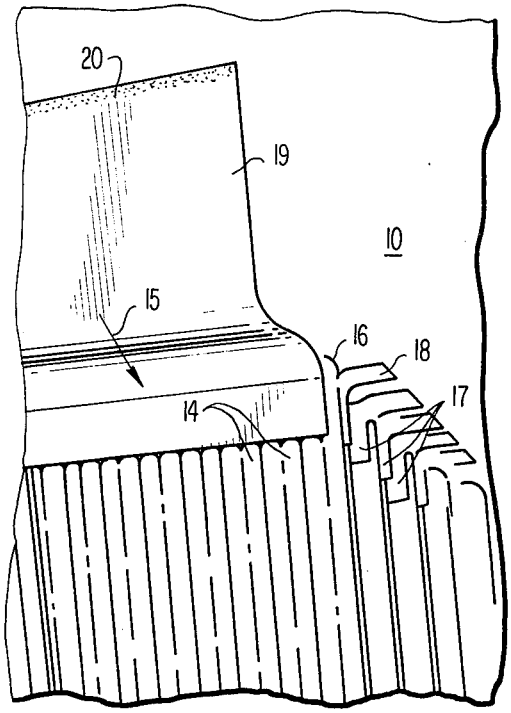
FIG. 2
FIG. 5
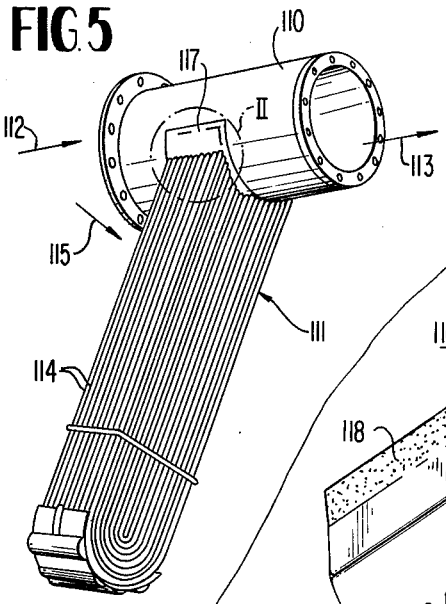
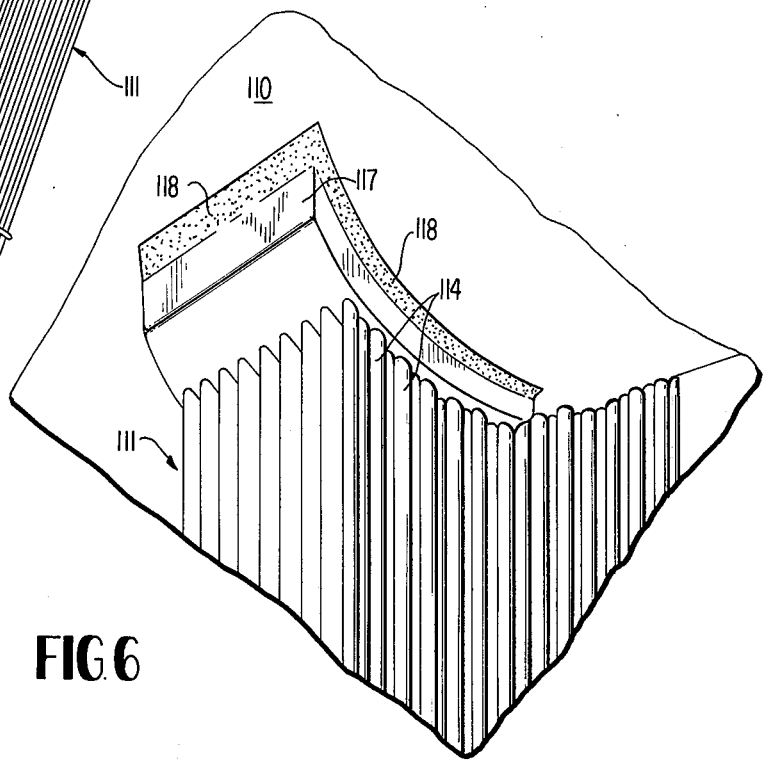
FIG. 6

HEAT EXCHANGER FOR GASES OF GREATLY VARYING TEMPERATURES

The present invention relates to a heat-exchanger for gases of greatly varying temperatures, especially for the use in gas turbines, consisting of a common or collecting chamber, for example, of a tubularly shaped collecting space for the colder gas with a metal recuperator which is formed by a number of preferably U-shaped bent pipes which are welded or brazed into the common or collecting chamber, and whereby the hotter gas flows through between the pipes of the recuperator.

Heat-exchangers of the aforementioned type are used customarily in gas turbines. The collecting chamber or common space is thereby constructed as guide pipe for the relatively cold air required for the combustion operation. The cold air enters into the heat-exchanger at one end of the guide pipe, heats up in the U-shaped pipes of the recuperator cicumcirculated by the hot exhaust gases of the turbine and is subsequently conducted to the combustion chamber. This known construction of a heat-exchanger, however, is prone to wear to a high extent under the temperature changes occurring in gas turbines. The places of the brazed or welded connections of the recuperator pipes at the guide pipe are thereby particularly endangered. They represent the criterion of the heat-exchanger determining the length of life thereof.

It is the aim of the present invention to considerably increase the service life of heat-exchangers of the aforementioned type. According to the basic concept of the present invention, the underlying problems are solved according to the present invention in a surprisingly simple and advantageous manner in that one or several sheet metal members are arranged within the area of the connecting places between the pipes of the recuperator and the collecting chamber for the deflection of the hot gases away from the connecting places. The sheet metal members according to the present invention deflect the gas stream away from the brazing locations and do not permit the gas stream to interact directly with the brazed places. As a result thereof, the large temperature fluctuations which occur during alternate and shock conditions (start, partial load, stop), can reach the brazed places only with a relatively large time-delay. The temperature gradients are so strongly reduced in the heat-exchanger construction according to the present invention that no damages occur any longer at the brazed places.

In one advantageous further development of its basic concept, the present invention proposes to arrange the sheet metal member or members transversely to the inflow direction of the hot gas. An optimum useful effect can be achieved thereby with minimum material expenditures. It is furthermore appropriate that the sheet metal member or members extend at least over the entire width of the recuperator.

According to a further important feature of the present invention, a sheet metal member covering off the corresponding connecting places between the recuperator and the collecting chamber or common space is to be arranged on at least the side of the recuperator facing the inflowing hot gases. As a result thereof, the hot exhaust gases are already deflected from the critical connecting places before they have even flown-in between the pipes of the recuperator.

An embodiment is preferred according to the present invention in which one sheet metal member each is additionally arranged between individual pipe rows of the recuperator transversely to the flow direction of the hot gases. It is thereby feasible, for example, that one provides one additional sheet metal member each between all of the rows. In this manner, each individual connecting place can be protected against the hot gases. Since, however, the connecting places of those pipe ends are particularly endangered against which flow the exhaust gases that have not yet cooled off, or have cooled off only little, It suffices already for the purposes of the present invention if the additional sheet metal members are arranged between the pipe rows following directly the pipe rows acted upon at first by the hot gas stream, preferably between the first six rows.

The protecting sheet metal members are appropriately constructed strip-shaped and are secured at the outer wall of the collecting chamber, and are preferably connected with the same by spot welding. In detail it is proposed in connecting therewith that the strip-shaped sheet metal members which are arranged between the individual pipe rows of the recuperator are secured, preferably spot-welded, with their ends projecting beyond the width of the recuperator at the ouuter wall of the common space or collecting chamber.

In another embodiment according to the present invention, the underlying problems are solved in a surprisingly simple and advantageous manner in that the outer wall of the collecting chamber or common space is surrounded concentrically by a protective sheet metal member within the area of the connecting places thereof with the pipes of the recuperator, which sheet metal member is provided with bores for extending therethrough the pipes of the recuperator. The protective sheet metal member according to the present invention prevents advantageously the rapid and direct access of the hot gases to the brazed places of the recuperator pipes. The large temperature fluctuations which occur during alternate and shock conditions (start, partial load, stop) can thus reach the brazed locations only with a relatively large delay of time. The temperature gradients are so strongly reduced in a heat-exchanger construction with the protective sheet metal member according to the present invention that no damages can occur any longer at the brazed locations.

Of course, it can do no damage in any case if the protective sheet metal member according to the present invention covers off all the pipe-connecting places (brazed locations). However, it has proved as completely adequate for the purposes of the present invention if the protective sheet metal member covers off only that half of the number of pipe-connecting places which face the hot gas stream. It is also possible, but by no means absolutely necessary, that the pipes of the recuperator are surrounded without play by the through-bores in the protective sheet metal member. Instead, it suffices if the bores in the protective sheet metal member have a radial play of about 0.3 mm. with respect to the recuperator pipes extending therethrough. Furthermore, the radial distance between the protective sheet metal member and the outer wall of the collecting chamber may amount to about 5 to 6 mm whereby it corresponds approximately to twice the amount of the axial expansion of the individual connecting places between the recuperator and the collector chamber.

In order to keep the protective sheet metal member in the optimum position with respect to the recuperator pipes, it is recommended according to a further feature of the present invention to provide several clamping elements at least at the edges of the protective sheet metal member which project laterally beyond the width of the recuperator. Angularly bent sheet metal strips may serve as clamping elements, which overlap with one end the protective sheet metal member and are secured with the other end, preferably by spot-welding, at the outer wall of the collective chamber or common space.

Accordingly, it is an object of the present invention to provide a heat-exchanger for gases of greatly varying temperatures which avoids by simple means the aforementioned shortcomings and drawbacks encountered in the prior art.

Another object of the present invention resides in a heat-exchanger for gases of greatly varying temperatures which have a relatively long service life.

A further object of the present invention resides in a heat-exchanger which is simple in construction, yet effectively prevents premature breakdowns due to wear.

A still further object of the present invention resides in a heat-exchanger which is relatively safe against the wear normally caused by the temperature fluctuations that occur in the operation of gas turbines.

Still another object of the present invention resides in a heat-exchanger of the type described above in which the temperature gradients are so strongly reduced that no damages occur any longer at the places where the recuperator pipes are brazed or welded to the common chamber.

Another object of the present invention resides in a heat-exchanger which permits a optimum utilization with minimum material expenditures.

These and other objects, features, and advantages of the present invention will become more apparent from the following description when taken in connection with the accompanying drawing which shows, for purposes of illustration only, two embodiments in accordance with the present invention, and wherein:

FIG. 1 is a perspective view of a heat-exchanger according to the present invention;

FIG. 2 is an enlarged partial perspective view illustrating the detail of FIG. 1 which is encircled by the dash and dot line circle A;

FIG. 5 is a perspective view of a modified embodiment of a heat-exchanger in accordance with the present invention;

FIG. 6 is a partial perspective view, on an enlarged scale, illustrating the details of the heat-exchanger of FIG. 5 which is encircled by the dash and dot line circle II;

Figure 3:
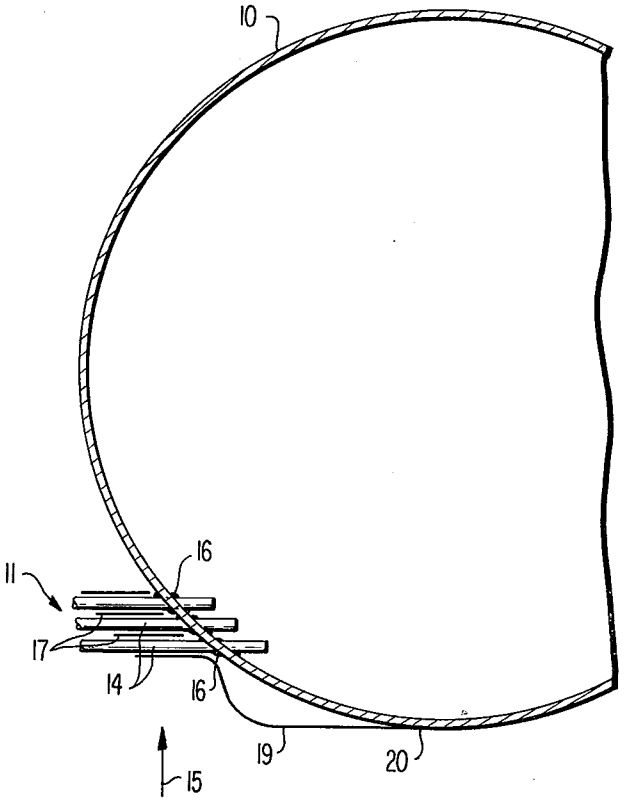
FIG. 3 is a somewhat schematic transverse cross-sectional view through the heat-exchanger according to FIGS. 1 and 2.

Referring now to the drawing wherein like reference numerals are used throughout the various views to designate like parts, and more particularly to the embodiment of FIGS. 1 through 4, reference numeral 10 designates the collective chamber or common space while reference numeral 11 generally designates the recuperator of the heat exchanger. The collective chamber 10 is constructed as guide pipe, into one end of which (arrow 12) enters the air required for the combustion operation of the gas turbine. After warm-up, the compressor air leaves the guide pipe 10 in the direction of arrow 13 and is conducted to the combustion chamber of the gas turbine (not shown).

The recuperator 11 consists of a large number of U-shaped curved pipes 14 which are arranged adjacent one another in several rows and nested one within the other and which project with their two ends into the interior space of the guide pipe 10 (FIG. 3). The pipes 14 are thereby brazed into corresponding bores provided in the wall of the guide pipes 10.

The hot exhaust gases of the turbine are conducted to the recuperator 11 in the direction indicated in FIG. 1 by arrow 15 and flow subsequently through between the individual pipes 14 whereby they give off a portion of their heat to the pipes. Sheet metal guide members or plates are arranged on the inside of the guide pipe 10 in a conventional, known manner and therefore not illustrated in detail herein, which force the combustion air to flow at first through the pipes 14 before they can leave the guide pipe 10 in the direction of arrow 13. The cold combustion air thus flowing through the guide pipe 10 is thereby correspondingly heated-up along its path.

Figure 4:
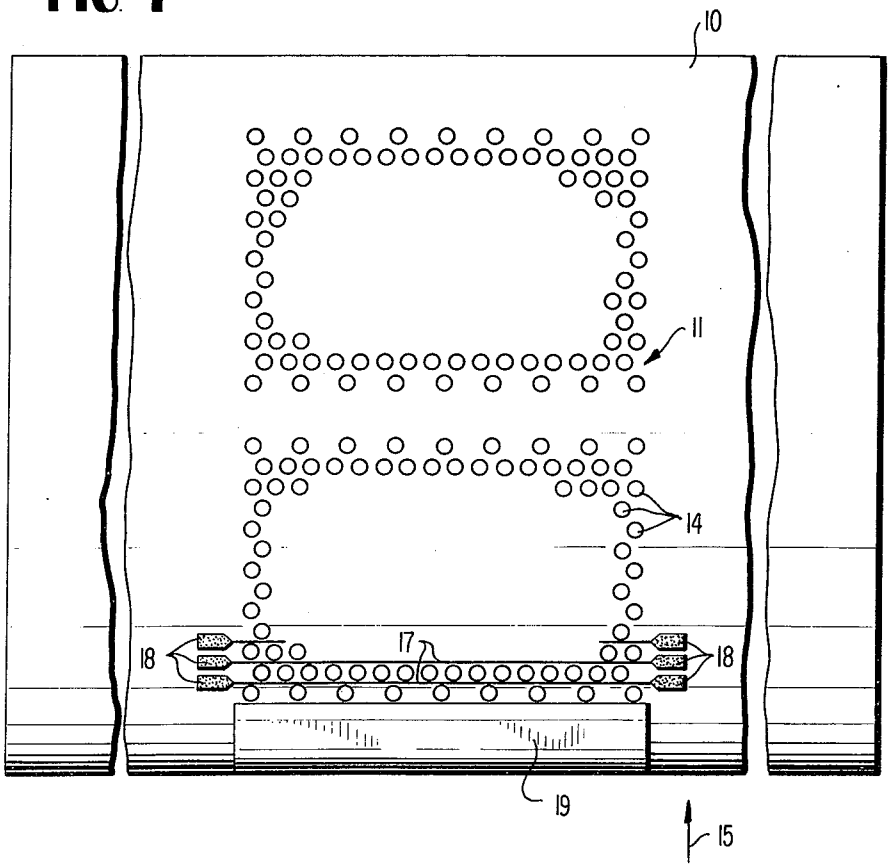
FIG. 4 is a partial plan view of the heat-exchanger of FIGS. 1 and 2 taken in the direction of arrow B in FIG. 3.
Figure 9:
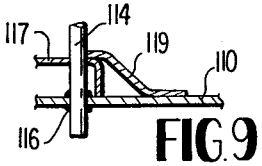
FIG. 9 is a partial cross-sectional view taken along line IX—IX of FIG. 7.

In order to protect the brazed places particularly endangered by the hot exhaust gases, designated in FIGS. 2 and 3 by reference numeral 16, these locations are covered off by several, preferably altogether five strip-shaped sheet metal plate-like members 17 which—as can be seen in particular from FIG. 4;13 are arranged transversely to the inflow direction (arrow 15) of the hot gases respectively between the individual rows of the pipes 14 of the recuperator 11 and are spot-welded with their ends 18 to the guide pipe 10. A further sheet metal plate-like member 19 which is constructed considerably wider and has an approximately S-shaped cross section (FIGS. 1–3), is arranged in front of the recuperator 11 on the side thereof facing the inflowing gas (arrow 15). This sheet metal member 19 is spot-welded to the guide pipe 10 and 20.

The brazed places 16 of the pipes 14 are effectively protected against the hot gas streams by the sheet metal members 17 and 19 in such a manner that the relatively large temperature fluctuations which occur during alternate and shock conditions (start, partial load, stop) can reach the brazed places only with a relatively large time delay. This effective protection of the brazed locations 16 against thermal shocks assures advantageously a high service length of the entire heat-exchanger.

In the embodiment according to FIGS. 5 – 9, reference numeral 110 designates the collective chamber or common space while reference numeral 111 generally designates the recuperator. The collective chamber 110 is again constructed as guide pipe, into one end of which (arrow 112) enters the air required for the combustion operation of the gas turbine. After the heat-up the combustion air leaves the guide pipe 110 in the direction of arrow 13 and is conducted to the combustion chamber (not shown) of the gas turbine.

Figure 7:
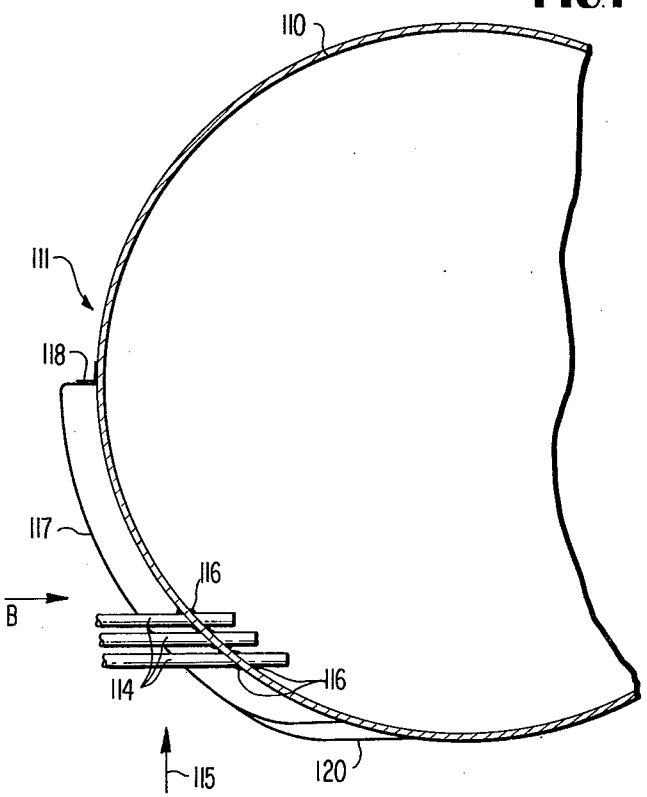
FIG. 7 is a somewhat schematic transverse cross-sectional view through the heat-exchanger according to FIGS. 5 and 6.
Figure 8:
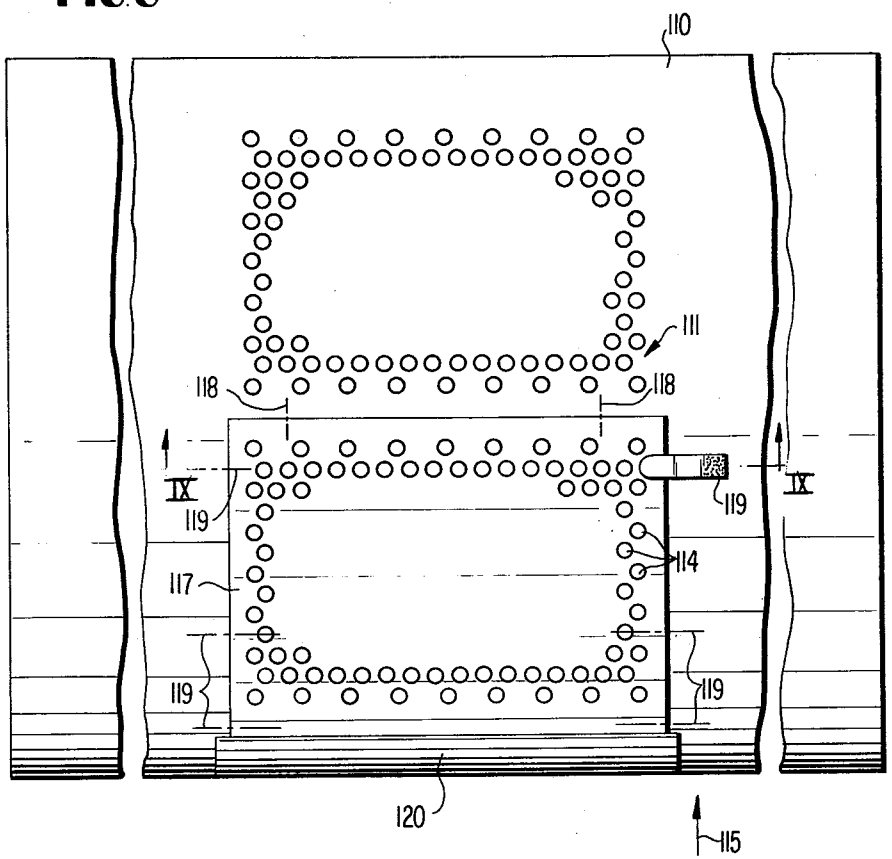
FIG. 8 is a plan elevational view of the heat-exchanger taken in the direction of arrow B in FIG. 7.

The recuperator 111 consists of a large number of U-shaped bent pipes 114 which are arranged adjacent one another in several rows and are nested one within the other and project with their two ends respectively into the interior space of the guide pipe 110 (FIG. 7). The pipes 114 are thereby brazed into corresponding bores provided in the walls of the guide pipe 110.

The hot exhaust gases of the turbine are conducted to the recuperator 111 in the direction indicated in FIG. 5 by an arrow 15 and subsequently flow through between the individual pipes 114 whereby they give off a part of their heat to these pipes. Guide or deflection members of sheet metal are arranged on the inside of the guide pipe 110, in a known, conventional manner and therefore not illustrated herein, which force the compressor air to flow at first through the pipes 114 before they leave the guide pipe 110 in the direction of arrow 113. The cold compressor air flowing through the guide pipe 110 and thus through the pipes 114 is thereby correspondingly heated-up along its path.

In order to protect the brazed places—designated in FIG. 7 by reference numeral 116—which are particularly endangered by the hot exhaust gases, these places 116, i.e., altogether one-half of all brazed places, are covered off by a protective sheet metal plate-like member 117. The protective sheet-metal member 117, as can be seen particularly well from FIG. 6, is spot-welded as its edges to the guide pipe 110 with the aid of sheet metal angle members 118. In the embodiment according to FIGS. 7 to 9, angularly bent clamping elements 119 are spot welded laterally of the protective member 117 in order to keep the protective sheet metal member 117 in the correct position. Furthermore, in this embodiment a sheet metal clamping member 120 secured respectively tangentially at the protective sheet metal member 117 and at the guide pipe 110 are provided for this purpose (See in particular FIG. 7). The brazed locations 116 of the pipes 114 are effectively protected by the sheet metal members 117 and 120 against the hot gas streams in such a manner that the large temperature fluctuations which occur during alternate and shock conditions (start, full load, stop) can reach the brazed locations only with a relatively large delay of time. This effective protection of the brazed places 116 against thermo-shocks again assures advantageously a long service life.

While we have shown and described only two embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What we claim is:

1. A heat-exchanger for gases of greatly varying temperatures, comprising a collective chamber means for the colder gases and a metal recuperator means through which a flow of hot gases is directed, said recuperator means including a plurality of pipe elements which are fastened to the collective chamber means and arranged such that adjacent pipe elements form aligned rows of pipe elements extending transversely to the flow direction of hot gases, characterized in that a protective means is arranged within the area of the connecting places between the pipe elements of the recuperator means and the collective chamber means for protecting the connecting places against the hot gases, said protection means extending transversely of the flow direction of the hot gases across at least two adjacent pipe elements in one of said plurality of aligned rows.

2. A heat-exchanger according to claim 1, characterized in that the collective chamber means is pipe-shaped.

3. A heat-exchanger according to claim 1, characterized in that the heat-exchanger is used in gas turbines.

4. A heat-exchanger according to claim 1, characterized in that the protective means includes at least one protective sheet-metal member arranged within the area of the connecting places between the pipe elements of the recuperator means and the collective chamber means for the deflection of the hot gases from the connecting places.

5. A heat-exchanger according to claim 4, characterized in that several protective sheet metal members are arranged within the area of the connecting places.

6. A heat-exchanger according to claim 4, characterized in that the length of the aligned rows of pipe elements extending transversely to the flow direction of the hot gases define the width of the recuperator means, and in that each protective sheet metal member extends at least over the entire width of the recuperator means.

7. A heat-exchanger according to claim 4, characterized in that an additional protective sheet metal member is provided at least on an upstream side of the recuperator means as viewed in the flow direction of the hot gases, the additional protective sheet metal member extends transversely of the flow direction of the hot gases and covers off connecting places of at least two adjacent pipe elements in one of said aligned rows which are directly exposed to the inflowing hot gases.

8. A heat-exchanger according to claim 7, characterized in that one protective sheet metal member each is arranged transversely to the flow direction of the hot gases between at least several of said aligned rows of pipe elements of the recuperator means.

9. A heat-exchanger according to claim 8, characterized in that the sheet metal members are arranged between the aligned rows of pipe elements following the aligned row of pipe elements directly acted upon at first by the hot gas stream.

10. A heat-exchanger according to claim 9, characterized in that the sheet metal members are arranged between at least a first six rows of said aligned rows of pipe elements of the recuperator means.

11. A heat-exchanger according to claim 9, characterized in that each of the sheet metal members are constructed as strip-shaped sheet metal members and are secured at the outer wall of the collective chamber means.

12. A heat-exchanger according to claim 11, characterized in that the strip-shaped sheet metal members are connected with the outer wall of the collective chamber means by spot welding.

13. A heat-exchanger according to claim 11, characterized in that the additional sheet-metal member which covers off the corresponding connecting places between the recuperator means and the collective chamber means is constructed bent approximately S-shaped in cross section and adjoins tangentially the outer wall of the collective chamber means.

14. A heat-exchanger according to claim 13, characterized in that the strip-shaped sheet metal means arranged between the aligned rows of pipe elements of the recuperator means are secured with the ends thereof projecting beyond the width of the recuperator means at the outer wall of the collective chamber means.

15. A heat-exchanger according to claim 14, characterized in that the strip-shaped sheet metal members are spot-welded with their ends to the outer wall of the collective chamber means.

16. A heat-exchanger according to claim 1, characterized in that one protective means each is arranged transversely to the flow direction of the hot gases between at least several of said aligned rows of pipe elements of the recuperator means.

17. A heat-exchanger according to claim 16, characterized in that the protective means are arranged between the aligned rows of pipe elements following the aligned row of pipe elements directly acted upon at first by the hot gas stream.

18. A heat-exchanger according to claim 16, characterized in that the protective means are arranged between at least a first six rows of said aligned rows of pipe elements of the recuperator means.

19. A heat-exchanger according to claim 16, characterized in that each of the protective means are constructed as strip-shaped sheet metal members and are secured at the outer wall of the collective chamber means.

20. A heat-exchanger according to claim 19, characterized in that the strip-shaped sheet metal members are connected with the outer wall of the collective chamber means by spot welding.

21. A heat-exchanger according to claim 19, characterized in that the strip-shaped metal members arranged between the aligned rows of pipe elements of the recuperator means are secured with the ends thereof projecting beyond the width of the recuperator means at the outer wall of the collective chamber means.

22. A heat-exchanger according to claim 1, characterized in that the protective means are constructed as strip-shaped sheet metal members and are secured at the outer wall of the collective chamber means.

23. A heat-exchanger according to claim 1, characterized in that the outer wall of the collective chamber means is surrounded within the area of the connecting places thereof with the pipe elements of the recuperator means substantially concentrically by a protective sheet metal means which has bores for the passage therethrough of the pipe elements of the recuperator means.

24. A heat-exchanger according to claim 23, characterized in that the protective means includes a protective sheet metal member covering off only that half of the number of the connecting places of the pipe elements which face the inflowing hot gases.

25. A heat-exchanger according to claim 24, characterized in that the bores in the protective sheet metal member have a radial play of about 0.3 mm. with respect to the recuperator pipe elements extending therethrough.

26. A heat-exchanger according to claim 25, characterized in that several clamping means are provided at least at the lateral edges of the protective sheet metal member projecting beyond the width of the recuperator means.

27. A heat-exchanger according to claim 26, characterized in that angularly bent sheet-metal strips serve as clamping means which overlap with one end the protective sheet metal member and are secured with the other end at the outer wall of the collective chamber means.

28. A heat-exchanger according to claim 27, characterized in that the sheet metal strips are spot-welded with the other end at the outer wall of the collective chamber means.

29. A heat-exchanger according to claim 27, characterized in that the protective sheet metal member is additionally retained at its edge facing the inflowing hot gases by a clamping sheet metal member partially overlapping the protective sheet metal member and secured substantially tangentially at the outer wall of the collective chamber means.

30. A heat-exchanger according to claim 29, characterized in that the clamping member is spot-welded to the outer wall of the collective chamber means.

31. A heat-exchanger according to claim 29, characterized in that the radial distance between the protective sheet metal member and the outer wall of the collective chamber means amounts to about 5 to about 6 mm. whereby it corresponds approximately to twice the amount of the axial expansion of the individual connecting places between the recuperator means and the collective chamber means.

32. A heat-exchanger according to claim 23, characterized in that the bores in the protective sheet metal member have a radial play of about 0.3 mm. with respect to the recuperator pipes extending therethrough.

33. A heat-exchanger according to claim 26, characterized in that several clamping means are provided at least at the lateral edges of the protective sheet metal member projecting beyond the width of the recuperator means.

34. A heat-exchanger according to claim 33, characterized in that angularly bent sheet-metal strips serve as clamping means which overlap with one end the protective sheet metal member and are secured with the other end at the outer wall of the collective chamber means.

35. A heat-exchanger according to claim 33, characterized in that the protective sheet metal member is additionally retained at its edge facing the inflowing hot gases by a clamping sheet metal member partially overlapping the protective sheet metal member and secured substantially tangentially at the outer wall of the collective chamber means.

36. A heat-exchanger according to claim 35, characterized in that angularly bent sheet metal strips serve as clamping means which overlap with one end the protective sheet metal member and are secured with the other end at the outer wall of the collective chamber means.

37. A heat-exchanger according to claim 23, characterized in that the radial distance between the protective sheet metal member and the outer wall of the collective chamber means amounts to about 5 to about 6 mm, whereby it corresponds approximately to twice the amount of the axial expansion of the individual connecting places between the recuperator means and the collective chamber means.

38. A heat-exchanger according to claim 8, characterized in that the length of the aligned rows of adjacent pipe elements extending transversely of the flow direction of the hot gases define the width of the recuperator means, and in that each of said protective sheet metal members extends at least over the entire width of the recuperator means.

39. A heat-exchanger according to claim 38, characterized in that the sheet metal members are arranged between the aligned rows of pipe elements following the aligned row of pipe elements directly acted upon at first by the hot gas stream.

40. A heat-exchanger according to claim 39, characterized in that the sheet metal members are arranged between at least a first six rows of said aligned rows of pipe elements of the recuperator means.

41. A heat-exchanger according to claim 40, characterized in that the additional sheet-metal member which covers off the corresponding connecting places between the recuperator means and the collective chamber means is constructed bent approximately S-shaped in cross section and adjoins tangentially the outer wall of the collective chamber means.

42. A heat-exchanger for gases of greatly varying temperatures, comprising a collective chamber means for the colder gases and a metal recuperator means having a number of pipes which are fastened to the collective chamber means, the hotter gases thereby flowing through between the pipes of the recuperator means, characterized by protective means arranged within the area of the connecting places between the pipes of the recuperator means and the collective chamber means for protecting the connecting places against the hot gases, the pipes are arranged in rows, and one protective means each is arranged transversely to the flow direction of the hot gases between at least several of the individual pipe rows of the recuperator means, and in that an additional protective means covers off the pipe-connecting places directly exposed to the inflowing hot gases and is constructed bent approximately S-shaped in cross section and adjoins tangentially the outer wall of the collective chamber means.

43. A heat-exchanger for gases of greatly varying temperatures, comprising a collective chamber means for the colder gases and a metal recuperator means having a number of pipes which are fastened to the collective chamber means, the hotter gases thereby flowing through between the pipes of the recuperator means, characterized by protective means arranged within the area of the connecting places between the pipes of the recuperator means and the collective chamber means for protecting the connecting places against the hot gases, and in that the protective means covers off the pipe-connecting places directly exposed to the inflowing hot gases and is constructed bent approximate S-shaped in cross section and adjoins tangentially the outer wall of the collective chamber means.

44. A heat-exchanger arrangement comprising: collecting means for collecting cold gases, recuperator means communicating with said collecting means and arranged in a flow direction of hot gases for receiving the cold gas and heating the same including a plurality of substantially U-shaped elements arranged adjacent one another and nested within one another such that adjacent pipe elements form aligned rows of pipe elements extending transversely to the flow direction of the hot gases, means for fixedly securing each of said pipe elements of said recuperator means to said collection means, means mounted on said recuperator means and said collecting means for protecting said securing means against thermal shocks, said protection means extending transversely of the flow direction of the hot gases across at least two adjacent pipe elements in one of said plurality of aligned rows.

45. A heat-exchanger according to claim 44, wherein said protecting means includes at least one protective sheet metal member arranged within the area of said securing means.

46. An arrangement according to claim 45, wherein said at least one sheet metal member is disposed between a first aligned row of adjacent pipe elements and a further aligned row of adjacent pipe elements, said further aligned row being arranged immediately adjacent the first aligned row as viewed in the flow direction of the hot gases.

47. An arrangement according to claim 45, wherein a sheet metal member is disposed between each of said plurality of aligned rows of pipe elements.

48. An arrangement according to claim 47, wherein an additional sheet metal member is provided and arranged on said collecting means and said recuperator means on an upstream side thereof, as viewed in the flow direction of the hot gases, said additional sheet metal member extending transversely of the flow direction of the hot gases across at least two adjacent pipe elements in one of said plurality of aligned rows.

49. An arrangement according to claim 44, wherein said protecting means includes a sheet metal member at least partially surrounding said collecting means within the area of said securing means, said sheet metal member being provided with bore means for passage therethrough of said pipe elements.

50. An arrangement according to claim 44, wherein the length of the aligned rows of adjacent pipe elements extending transversely to the flow direction of the hot gases define the width of the recuperator means, and wherein said protecting means extends at least over the entire width of said recuperator means.

51. An arrangement according to claim 50, wherein said protecting means includes at least one protective sheet metal member disposed between adjacent aligned rows of pipe elements.

52. An arrangement according to claim 51, wherein a sheet metal member is disposed between each of said plurality of aligned rows of pipe elements.

53. An arrangement according to claim 52, wherein an additional sheet metal member is provided and arranged on said collecting means and said recuperator means on an upstream side thereof, as viewed in the flow direction of the hot gases, said additional sheet metal member extending transversely of the flow direction of the hot gases across at least two adjacent pipe elements in one of said plurality of aligned rows.

54. An arrangement according to claim 52, wherein an additional sheet metal member is provided and arranged on said collecting means and said recuperator means on an upstream side thereof, as viewed in the flow direction of the hot gas, said additional sheet metal member extending transversely of the flow direction of the hot gases across at least the entire width of said recuperator means.

* * * * *